US005765388A

United States Patent [19]

Jeon

[11] Patent Number: 5,765,388

[45] Date of Patent: Jun. 16, 1998

[54] REFRIGERATOR WITH AIR CURTAIN GENERATING DEVICE

[75] Inventor: Yong-Deok Jeon, Seoul, Rep. of Korea

[73] Assignee: Daewoo Electronics Co., Ltd., Seoul, Rep. of Korea

[21] Appl. No.: 866,068

[22] Filed: May 30, 1997

[30] Foreign Application Priority Data

Sep. 25, 1996 [KR] Rep. of Korea ..... 96-42583

[51] Int. Cl.[6] ..... F25D 17/04

[52] U.S. Cl. ..... 62/408; 62/441

[58] Field of Search ..... 62/404, 407, 408, 62/405, 419, 426, 441, 442, 256; 454/193, 192

[56] References Cited

U.S. PATENT DOCUMENTS 4,379,391 4/1983 Rhee ..... 62/408
4,899,554 2/1990 Kato et al. ..... 62/442

*Primary Examiner*—William Doerrler
*Attorney, Agent, or Firm*—Cushman Darby & Cushman Intellectual Property Group of Pillsbury Madison & Sutro, LLP

[57] ABSTRACT

A refrigerator for selectively discharging vertical stream of cool air to the front of the freezer and freshfood compartments is disclosed. The refrigerator comprises: a cabinet formed with a freezing compartment and a fresh food compartment, which are partitioned by a partitioning wall; an evaporator for generating cool air; a fan for transferring the cool air to the freezing compartment and the fresh food compartment; an air curtain duct installed at the partitioning wall, for transferring the cool air generated by the evaporator to doors for the freezing compartment and the fresh food compartment; an upper and lower air curtain ports formed at the front end portion of the air curtain duct, for discharging the cool air towards the freezing compartment and fresh food compartment; a cross flow fan installed in air curtain duct, for supplying the cool air to the air curtain duct; and a changing damper for selectively closing the upper or lower air curtain port to selectively directing the cool air supplied through air curtain duct to the freezing compartment or the fresh food compartment. Thus, leakage of the cool air through the openings of the freezing compartment and the fresh food compartment can be effectively prevented, and the temperatures in the both compartments are maintained constant, thus enhancing the cooling efficiency.

4 Claims, 6 Drawing Sheets

REFRIGERATOR WITH AIR CURTAIN GENERATING DEVICE

BACKGROUND OF THE INVENTION

1. Field of the Invention

The present invention relates to a refrigerator, and more particularly to a refrigerator with an air curtain generating device in which cool air is selectively discharged to a fresh food compartment or a freezing compartment to generate an air curtain.

2. Prior Art

FIG. 1 shows a section of a conventional refrigerator. The refrigerator has, as shown in FIG. 1, a cabinet 100 formed with a freezing compartment 101 and a fresh food compartment 102 which are partitioned from each other by a wall (not shown), and a freezing compartment door 103 and a fresh food compartment door 104 for opening and closing the freezing compartment 101 and the fresh food compartment 102, respectively. The doors 103 and 104 are mounted on the cabinet 100 by a hinge.

A plurality of shelves 105 are mounted inside the freezing compartment 101 and the fresh food compartment 102. A compressor (not shown) is installed at the back of a rear wall 112 of the fresh food compartment 102 formed at the lower part compartment 100, and an evaporator 106 is installed at the back of a rear wall 111 of the freezing compartment 101 formed at the upper part of the cabinet 100 for evaporating a refrigerant supplied from the compressor by absorbing heat from the surroungings to generate cool air.

A first fan 107 for blowing the cool air generated by the evaporator 106 to a freezing compartment 101, and a second fan (not shown) for blowing the cool air generated by the evaporator 106 to the fresh food compartment 102 through a multi-duct structure 108, are installed above the evaporator 106.

A first cool air circulation duct 109 is installed above the wall partitioning the freezing compartment and the fresh food compartment, in parallel with the wall, and second cool air curculation duct 110 is installed below the wall in parallel with the wall, so that the cool air is circulated inside the freezing compartment 101 and the fresh food compartment 102.

Cool air discharging ports 111*a* and 112*a* are formed on the rear wall 111 of the freezing compartment 101 and the rear wall 112 of the fresh food compartment 102, so that the cool air generated by the evaporator 106 is blown into the freezing compartment 101 and the fresh food compartment 102 by the first fan 107 and the second fan.

Hereinbelow, the operation of a conventional refrigerator will be described.

When power is supplied to the refrigerator, a compressor is operated and the refrigerant is circulated through the refrigeration cycle of the refrigerator. At this point, the evaporator 106 generates the cool air by absorbing the heat from the surrounding air.

In this state, the first fan 107 is operated, so that part of the the cool air generated by the evaporator 106 is directly blown into the freezing compartment 101 through the cool air discharging port 111*a* of the rear wall 111 of the freezing compartment 101. At the same time, the second fan is operated, so that the remaining part of the cool air is blown toward the fresh food compartment 102 through the multi-duct 108, and then supplied into the fresh food compartment 102 through the cool air discharging port 112*a* of the rear wall 112 of the fresh food compartment 102.

At this time, the cool air is blown horizontally from the rear side of the freezing compartment 101 and the fresh food compartment 102 to the front side thereof.

The cool air blown to the freezing compartment 101 and the fresh food compartment 102 returns to the evaporator 106 through the first cool air circulation duct 109 and the second cool air circulation duct 110. The cool air re-supplied to the freezing compartment 101 and the fresh food compartment 102 by the first fan 107 and the second fan forms a cool air circulation in the refrigerator.

Through the process described above, the temperature of the freezing compartment 101 is maintained at −18° C., and the temperature of the fresh food compartment 102 is maintained at 0°–9° C.

Two push button switches (not shown) installed on the front walls (not shown) of the freezing compartment 101 and the fresh food compartment 102, adjacent to the freezing compartment door 103 and the fresh food compartment door 104, respectively, to operate the first fan 107 and the second fan.

When the freezing compartment 101 and the fresh food compartment 102 are closed, each push button switch is pressed by a hinge side of each door, so that the first fan 107 and the second fan are operated according to a predertermined control signal from a microprocessor (not shown).

On the contrary, when the freezing compartment 101 or the fresh food compartment 102 is opened, each push button switch is released, so that the first fan 107 and the second fan are not operated.

The conventional refrigerator has the following problem.

When the freezing compartment door 103 and the fresh food compartment 104 are opened, an external warm air flows into the compartments without a resistance, thereby causing the leakage of the cool air, making the refrigerator energy inefficient.

To solve the above problem, a refrigerator having devices for generating an air curtain for shuttng off opening of a freezing compartment and a fresh food compartment has been disclosed by the arts. However, the refrigerators have a complicated structure in that air curtain generating divices are installed on the freezing compartment and the fresh food compartment, separately.

SUMMARY OF THE INVENTION

It is an object of the present invention to provide a refrigerator with an air curtain generating device for selectively generating an air curtain in a freezing compartment and a fresh food compartment, when a freezing compartment door or a fresh food compartment door is opened.

It is another object of the present invention to provide a refrigerator being capable of maintaining a constant temperature in a freezing compartment and a fresh food compartment, to enhance a cooling efficiency of the refrigerator by effectively preventing the leakage of cool air from the freezing and fresh food compartments.

To achieve the above objects, the present invention provides a refrigerator comprising a cabinet formed with a freezing compartment and a fresh food compartment, which are partitioned by a partitioning wall; an evaporator for generating cool air; a fan transferring the cool air to the freezing compartment and the fresh food compartment; an air curtain duct installed at the partitioning wall, for transferring the cool air generated by the evaporator to doors for said freezing compartment and said fresh food compartment; upper and lower air curtain ports formed at the front end portion of the air curtain duct, for discharging the cool air toward the freezing compartment and the fresh food compartment; a first air curtain suction port installed at an upper wall of said freezing compartment, adjacent to said freezing compartment door, for inhaling the cool air discharged from the upper air curtain port to generate an air curtain at the opening part of the freezing compartment; a second air curtain suction port installed at a lower wall of the fresh food compartment, adjacent to the fresh food compartment door, for inhaling the the cool air discharged from the lower air curtain port to generate an air curtain at the opening part of the fresh food compartment; an air curtain circulation duct for connecting the first air curtain suction port, the second air curtain suction port and the air curtain duct; a cross flow fan installed in the air curtain duct, for supplying the cool air to the air curtain duct; and a changing damper for selectively closing said upper or lower air curtain port to selectively directing the cool air supplied through the air curtain duct toward the freezing compartment or said fresh food compartment.

Here, it is preferable that changing damper is of a bar having a cross-sectional shape of a fan or gingko leaf shape.

BRIEF DESCRIPTION OF THE DRAWINGS

The present invention will be better understood and its various objects and advantages will be more fully appreciated from the following description taken in conjunction with the accompanying drawings, in which.

DESCRIPTION OF THE PREFERRED EMBODIMENT

Reference will now be made in detail to the present invention, examples of which are illustrated in the accompanying drawings. Wherever possible, the same reference numbers will be used throughout the drawings to refer to the same or like parts.

Figure 1:
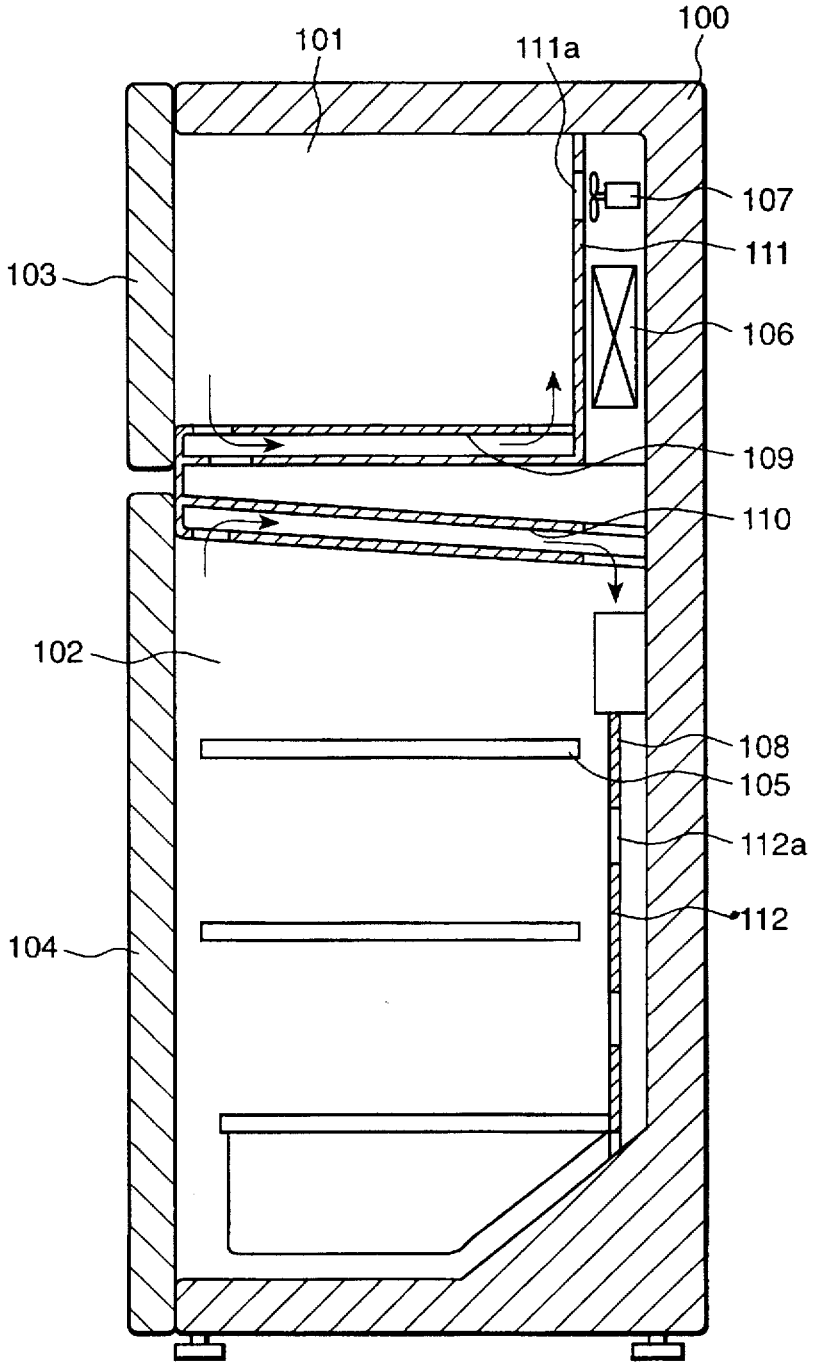
Fig. 1 (PRIOR ART)
FIG. 1 shows a conventional refrigerator.
Figure 2:
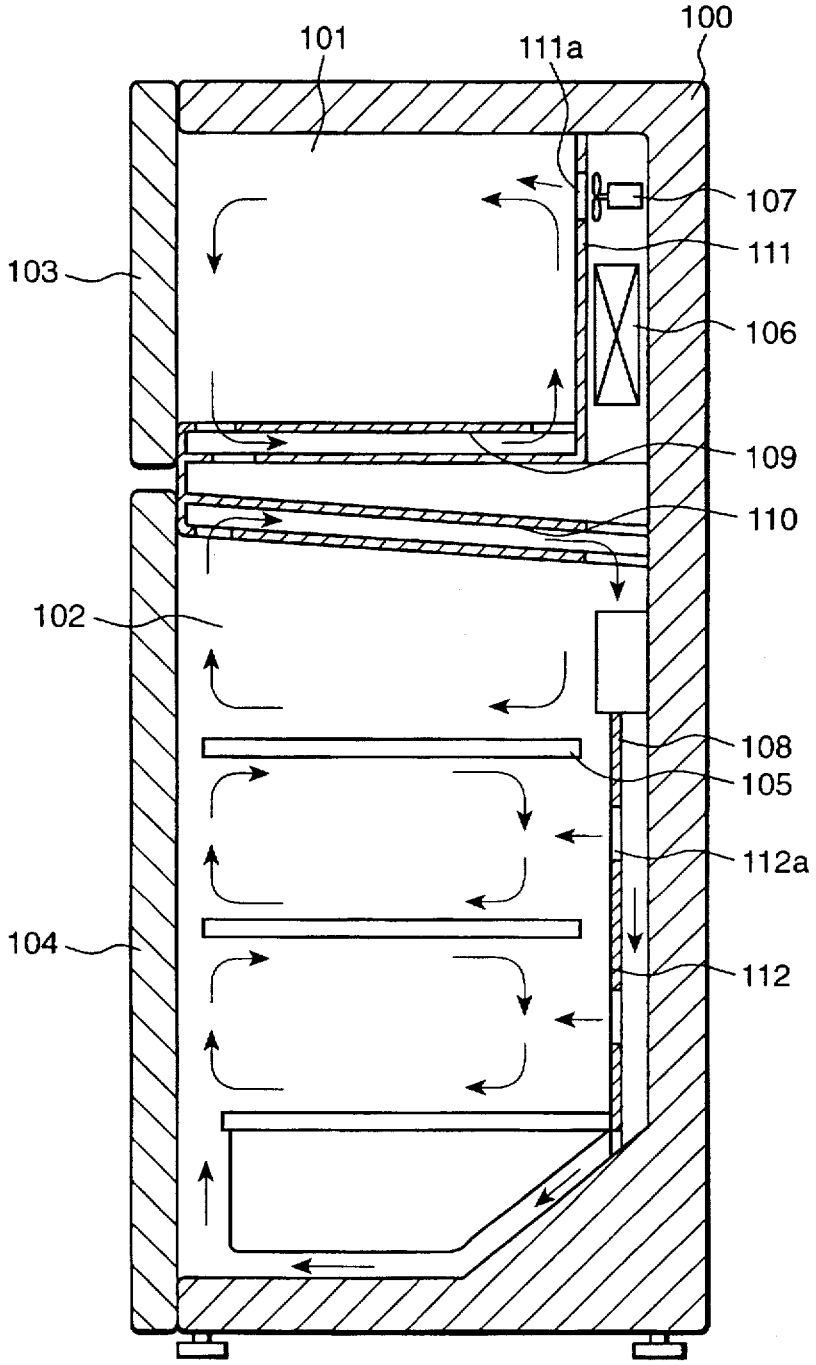
Fig. 2 (PRIOR ART)
FIG. 2 shows an air flow inside of the conventional refrigerator.
Figure 3:
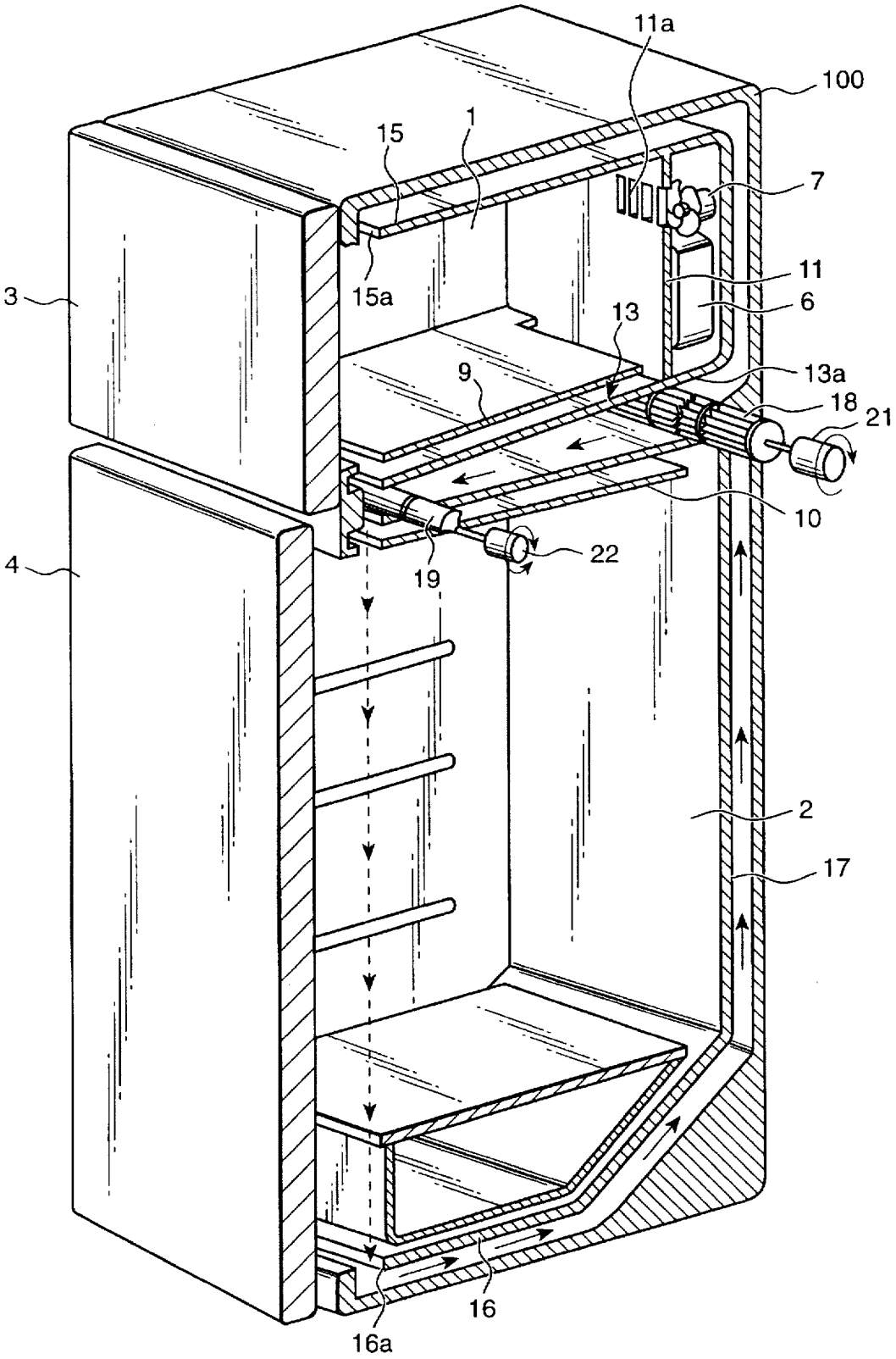
FIGS. 3, 4 shows a refrigerator according to the present invention.
Figure 4:
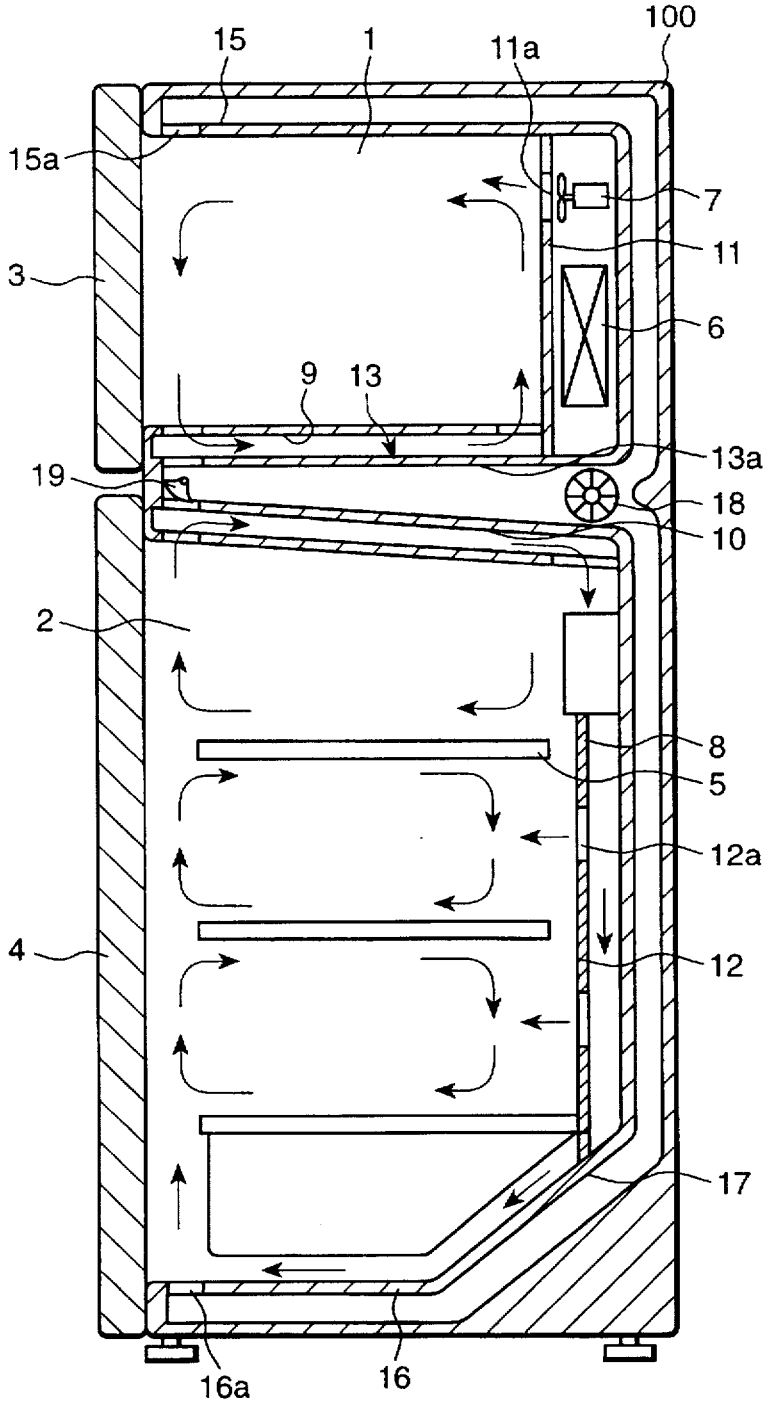

A refrigerator according to the present invention has, as shown in FIGS. 3 and 4, a cabinet 100 formed with a freezing compartment 1 and a fresh food compartment 2, which are partitioned from each other by a partiton wall 13, and a freezing compartment door 3 and a fresh food compartment door 4 for opening and closing the freezing compartment 1 and the fresh food compartment 2, respectively. The door3 and 4 are hingedly mounted on the cabinet 100.

A plularity of shelves 5 are mounted inside the freezing compartment 1 and the fresh food compartment 2.

A compressor (not shown) is installed at the back of a rear wall 12 of the fresh food compartment 2 formed at the lower part of the cabinet 100, and an evaporator 6 is installed installed at the back of a rear wall 11 of the freezing compartment 1 formed at the upper part of the cabinet 100 for evaporating a refrigerant supplied from the compressor by absorbing the heat from the surroundings to generate cool air.

A first fan 7 for blowing the cool air generated by the evaporator 6 to the freezing compartment 1, and a second fan (not shown) for blowing the cool air generated by the evaporator 6 to the fresh food compartment 2 through a multi-duct structure 8, are installed above the evaporator 6.

A first cool air circulation duct 9 is installed above the partitioning wall, in parallel with the wall 13, and a second cool air circulation duct 10 is installed below the wall 13 in parallel therewith, so that the cool air is circulated inside the freezing compartment 1 and the fresh food compartment 2.

Cool air discharging ports **11*a* and 12*a* are formed in the rear walls 11 and 12 of the freezing compartment 1 and the fresh food compartment 2, respectively, so that the cool air generated by the evaporator 6 is blown into the freezing compartment 1 and the fresh food compartment 2 by the first fan 7** and the second fan, respectively.

An air curtain duct **13*a* is installed at the wall 13 between the first cool air circulation duct 9 and the second cool air circulation duct 10, to guide the cool air generated by the evaporator 6 toward the freezing compartment 1 and the fresh food compartment 2. Curtain ports, 14*a* and 14*b* are formed at a front end portion of the air curtain duct 13*a*, so that the cool air in the air curtain duct 13*a* is discharged to the freezing compartment 1 and the fresh food compartment 2, through the air curtain port 14*a* and 14*b*, respectively (see FIG. 8). At an upper wall 15 of the freezing compartment 1, a first air curtain suction port 15*a* is formed adjacent to the freezing compartment door 3, to inhale the cool air from the upper air curtain port 14*a*, thereby generating a vertical stream of cool air forming an air curtain at the opening part of the freezing compartment 1. Also, at a lower wall 16 of the fresh compartment 2, a second air curtain suction port 16*a* is formed adjacent to the fresh food compartment door 4 to inhale the cool air from the lower air curtain port 14*b*, thereby generating a vertical stream of cool air forming an air curtain at the opening part of the fresh food compartment 2**.

The first air curtain suction port **15*a*, the second air curtain suction port 16*a* and the air curtain duct 13*a* are interconnected one another by an air curtain circulation duct 17**.

In the air curtain duct **13*a*, a cross flow fan 18 circulates the cool air from the air curtain circulation duct 17 supplying the cool air toward the air curtain ports 14*a* and 14*b*. The cross flow fan 18 is driven by a driving motor 21**.

A changing damper bar 19 having a cross-sectional shape of a fan or gingko leaf is installed horizontally in a lengthwise direction of the air curtain ports **14*a* and 14*b* to rotate within a predetermined angle, thereby selectively closing the air curtain ports 14*a* and 14*b*. Therefore, the cool air flowing toward the air curtain ports 14*a* and 14*b* through the air curtain duct 13*a* is selectively discharged to the freezing compartment 1 or to the fresh food compartment 2. The changing damper bar 19 is rotated by a stepping motor 22 for driving the changing damper bar 19**, by a predertermined angle.

Two push button switches are installed on the front part of the freezing compartment 1 and the fresh food compartment 2, adjacent to the freezing compartment door 3 and the fresh food compartment door 4, respectively. When the freezing compartment 1 and the fresh food compartment 2 are closed, each push button switch is pressed by the side of each door. On the contrary, when the freezing compartment 1 and the fresh food compartment 2 are opened, each push button switch is released.

A controller such as a microprocessor (not shown) recognizes that each door is opened, when each push button is released.

When each door is opened, and the push button switch is released, the microprocessor stops the operation of the first and second fans, and drives the stepping motor to rotate the changing damper bar 19, for generating the air curtain at the opening part of the compartment of which the door is opened.

Hereinbelow the operation and its effect of the refrigerator according to the present invention will be described.

When the freezing compartment 1 and the fresh food compartment 2 are closed, each push button switch is pressed by the side of each door, so that the microprocessor operates the first fan 7 and the second fan. Accordingly, the cool air is discharged from the rear part of the refrigerator to the freezing compartment 1 and the fresh food compartment 2. Then, the cool air goes out of the freezing compartment 1 and the fresh food compartment 2 to be circulated through the cool air circulation duct 9 and 10.

Figure 5:
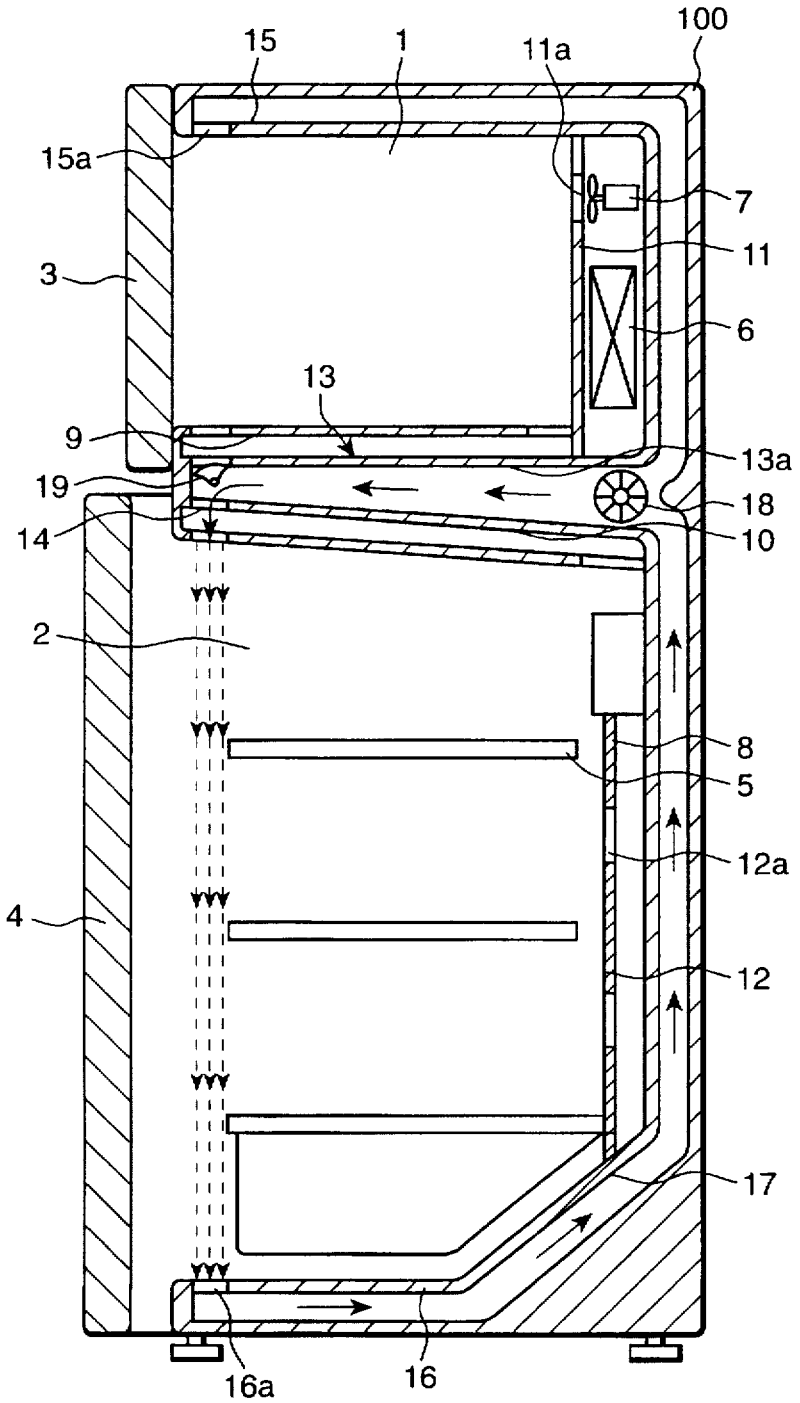
FIG. 5 shows an air curtain generated when a fresh food compartment door of the refrigerator of FIG. 4 is opened.
Figure 6:
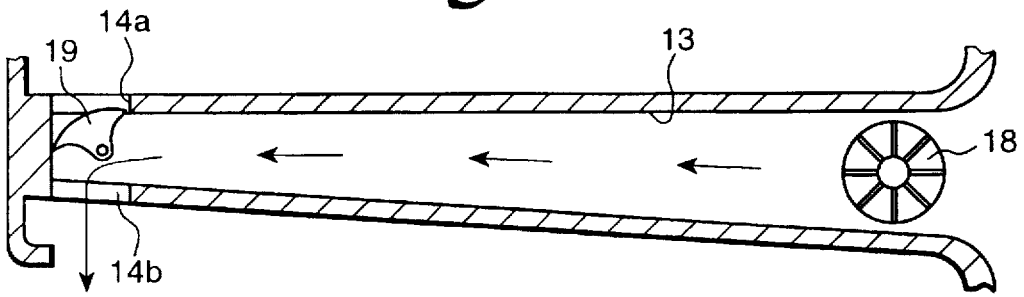
FIGS. 6 and 7 show operations of a changing damper bar installed at a partioning wall in the refrigerator of FIG. 4.
Figure 8:
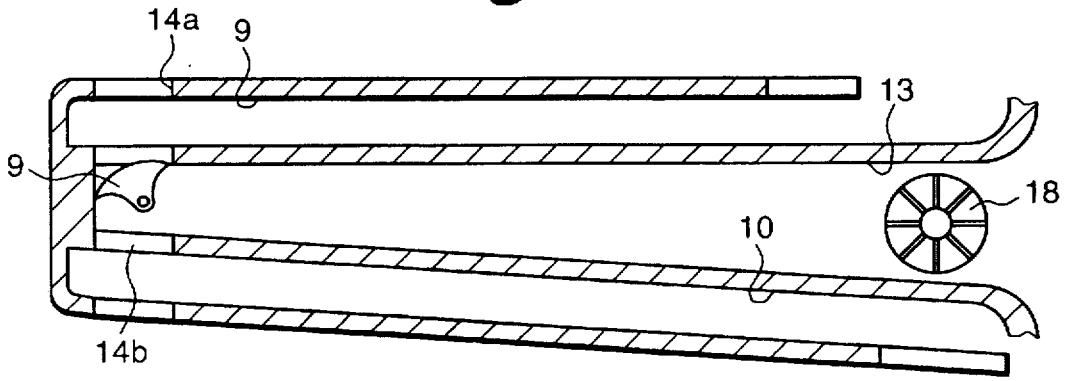
FIG. 8 shows an enlarged diagram of main parts of the refrigerator according to the present invention.

When the fresh food compartment 4 is opened, the push button switch is released, as shown in FIGS. 5, 6 and 8. At this time, the micro processor senses that the door is opened and stops the operation of the second fan to prevent the cool air from flowing into the fresh food compartment 2. Also, the microprocessor drives the stepping motor 22 to rotate the changing damper bar 19, thereby closing the upper air curtain port 14*a*.

Accordingly, the cool air generated by the evaporator 6 and transferred through the air curtain duct 13*a* is discharged only toward the fresh food compartment 2 through the air curtain port 14. The cool air discharged toward the fresh food compartment 2 flows into the second air curtain suction port 16*a* to generate the air curtain at the opening part of the fresh food compartment 2, therby preventing the external warm air from flowing into the fresh food compartment 2.

The cool air for generting the air curtain passes through the second air curtain suction porta and is circulated through the air curtain circulation duct 17. The cool air flowing inside the air curtain circulation duct 17 is transferred into the air curtain duct 13*a* to be re-discharged to the lower air curtaion port 14*b*. At this time, the cross flow fan 18 in the air curtain duct 13*a* operated by the microprocessor, directs the cool air flowing inside the air curtain circulation duct 17 to the air curtain duct 13*a* with ease.

Figure 7:
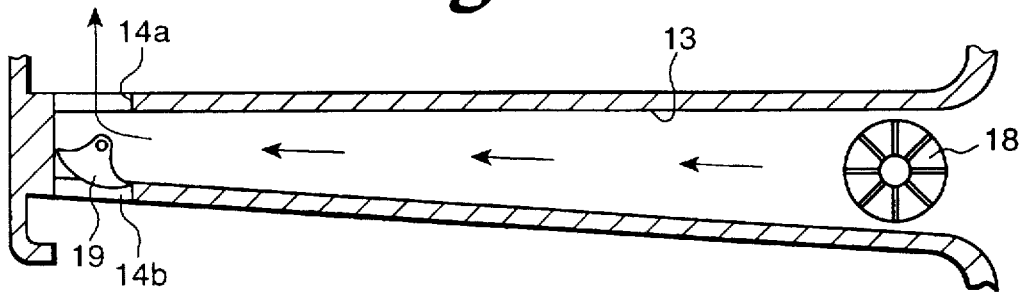

When the freezing compartment door 3 is opened, as shown in FIG. 7, the changing damper bar 19 is reversely rotated by the stepping motor to close the lower air curtain port 14*b*. Accordingly, the cool air transferred through the upper air curtain port 14*a* to the first air curtain suction port 15*a* to form the air curtain at the opening part of the freezing compartment 1.

As described above, according to the present invention, the air curtain is generated at the opening part of the compartment of which the door is opened by controlling the changing damper bar. Accordingly, leakage of the cool air through the opening of the freezing compartment and the fresh food compartment is effectively prevented, so that temperatures in the freezing compartment and the fresh food compartment are maintained constant, thus the cooling dfficiency of the refrigerator is enhanced.

Although the present invention has been described and illustrated in detail, it is clearly understood that the same is by way of illustration and example only and is not to be taken by way of limitation wherein the spirit and scope of the present invention is limited only by the terms of the appended claims.

What is claimed is:

1. A refrigerator comprising:

a cabinet formed with a freezing compartment and a fresh food compartment, which are partitioned by a partitioning wall;

an evaporator for generating cool air;

a fan transferring the cool air to said freezing compartment and said fresh food compartment;

an air curtain duct installed at said partitioning wall, for transferring the cool air generated by said evaporator to doors for said freezing compartment and said fresh food compartment;

upper and lower air curtain ports formed at the front end portion of said air curtain duct, for discharging the cool air toward said freezing compartment and said fresh food compartment;

a first air curtain suction port installed at an upper wall of said freezing compartment, adjacent to said freezing compartment door, for inhaling the cool air discharged from said upper air curtain port to generate an air curtain at the opening part of said freezing compartment;

a second air curtain suction port installed at a lower wall of said fresh food compartment, adjacent to said fresh food compartment door, for inhaling the the cool air discharged from said lower air curtain port to generate an air curtain at the opening part of said fresh food compartment;

an air curtain circulation duct for connecting said first air curtain suction port, said second air curtain suction port and said air curtain duct;

a cross flow fan installed in said air curtain duct, for supplying the cool air to said air curtain duct; and a changing damper for selectively closing said upper or lower air curtain port to selectively directing the cool air supplied through said air curtain duct toward said freezing compartment or said fresh food compartment.

2. The refrigerator as claimed in claim 1, wherein said changing damper is of a bar having a cross-sectional shape of a fan or gingko leaf shape.

3. The refrigerator as claimed in claim 1, further comprising a stepping motor for driving said changing damper.

4. The refrigerator as claimed in claim 2, further comprising a stepping motor for driving said changing member.

* * * * *